US005443042A

United States Patent [19]

Kiefer

[11] Patent Number: 5,443,042

[45] Date of Patent: Aug. 22, 1995

[54] COOLING DEVICE FOR INTERNAL-COMBUSTION ENGINE

[75] Inventor: Guenther Kiefer, Markdorf, Germany

[73] Assignee: MTU Motoren und Turbinen Union, Friedrichshafen, Germany

[21] Appl. No.: 272,757

[22] Filed: Jul. 11, 1994

[30] Foreign Application Priority Data

Jul. 10, 1993 [DE] Germany ..... 43 23 176.4

[51] Int. Cl.[6] ..... F01P 7/10

[52] U.S. Cl. ..... 123/41.49; 165/151

[58] Field of Search ..... 165/151, 122, 124; 123/41, 49

[56] References Cited

U.S. PATENT DOCUMENTS 4,169,501 10/1979 Takeuchi et al. ..... 123/41.49
4,938,303 7/1990 Schaal et al. ..... 123/41.48

FOREIGN PATENT DOCUMENTS 2499233 8/1982 France ..... 165/151
6606723 7/1967 Germany .
3822052A1 1/1989 Germany .
3836373A1 10/1989 Germany .
249147A 12/1980 United Kingdom .

*Primary Examiner*—Noah P. Kamen
*Attorney, Agent, or Firm*—Evenson McKeown Edwards & Lenahan

[57] ABSTRACT

A radiator through which a coolant flows and which is cooled by the cooling air supplied by a cooling air blower is associated with an internal combustion engine as a rule. An airflow guidance housing disposed between the radiator and the cooling air blower is used to guide the air. With an uneven flow of cooling air, the maximum efficiency of the radiator cannot be utilized. The cooling air flow is evened out and the cooling output is increased in that the flow resistance in the radiator or in a flow grating associated with it is greater in the areas close to the cooling air blower than in the areas remote from the cooling air blower. To achieve corresponding flow resistances, it is contemplated to make the distances between cooling fins in the radiator or segments in the flow grating of different width in the respective zones.

17 Claims, 1 Drawing Sheet

COOLING DEVICE FOR INTERNAL-COMBUSTION ENGINE

BACKGROUND AND SUMMARY OF THE INVENTION

The invention relates to a cooling device for an internal combustion engine, having a radiator through which a coolant flows, and with at least one cooling air blower and an airflow guide housing disposed between the radiator and the cooling air blower.

A radiator through which a coolant flows and which is cooled by the cooling air supplied by a cooling air blower is associated with an internal combustion engine as a rule. An airflow guidance housing disposed between the radiator and the cooling air blower is used to guide the air.

Because of restricted space conditions, quite often the cooling air blower is disposed asymmetrically in respect to the radiator, such as is disclosed, for example, in German Patent Publication DE 38 22 052 A1. The result is a greatly varied supply of different areas of the radiator with the cooling air flow forced by the cooling air blower and the airflow guide housing. To even out the flow it is proposed to provide an additional interior housing inside the airflow guide housing which divides the aspiration area of the cooling air blower, so that various areas of the radiator are supplied with different cooling air flows.

In a cooling installation in accordance with German Utility Model DE-GM 66 06 723 for a locomotive, the heat exchangers have been moved so close to a cooling air blower, again because of restricted space conditions, so that cooling air does not flow in equal amounts through all surface areas of a heat exchanger, particularly the one located on the pressure side. To even out the flow-through, this heat exchanger is equipped with cooling segments, which have great flow-through resistance.

Shutters disposed in the arch of the roof of the locomotive have no effect on the flow in the heat exchanger.

It is an object of the invention to increase the cooling output of heat exchangers for internal combustion engines by making the cooling air flow more even.

It is not possible to increase the cooling output of a heat exchanger arbitrarily by increasing the conveying output of a cooling air blower because, once a defined limit speed of the flow has been exceeded, the exchange ratio of a heat exchanger falls off again. An increase in the cooling output can be obtained by evening out the cooling air flow, i.e. a flow covers all areas of the radiator with optimum speed.

This is attained in accordance with an embodiment of the invention in that in areas close to the cooling air blower, where high flow speeds are expected, the flow resistance of the radiator is increased in respect to areas where the flow is slower because they are remote from the cooling air blower.

In accordance with another embodiment of the invention, different flow resistances in different cooler areas are generated by different spacing of cooling fins. The cooling fins in areas close to the cooling air blower are disposed closer together than in the areas remote from the cooling air blower.

In accordance with still another embodiment of the invention, the cooling air is laterally deflected in the airflow guide housing after flowing through the radiator. It is advantageous here to embody the half of the radiator which is close to the cooling air blower with closely spaced cooling fins and the half of the radiator which is remote from the cooling air blower with widely spaced cooling fins in order to obtain an evening out of the flow.

In accordance with yet another embodiment of the invention, the desired flow resistance is obtained by a flow grating disposed on the radiator in the cooling air flow, wherein the flow resistance of the flow grating is made greater in the areas of the radiator which are close to the cooling air blower than in the zones remote from the cooling air blower. An evening out of the flow is also achieved by means of this arrangement, so that the output of the radiator can be better utilized.

In accordance with a further embodiment of the invention, segments are provided in the flow grating which are closer together in the zones with higher flow resistance than in zones of low flow resistance.

In accordance with another embodiment of the invention the radiator is disposed on the aspirating side.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
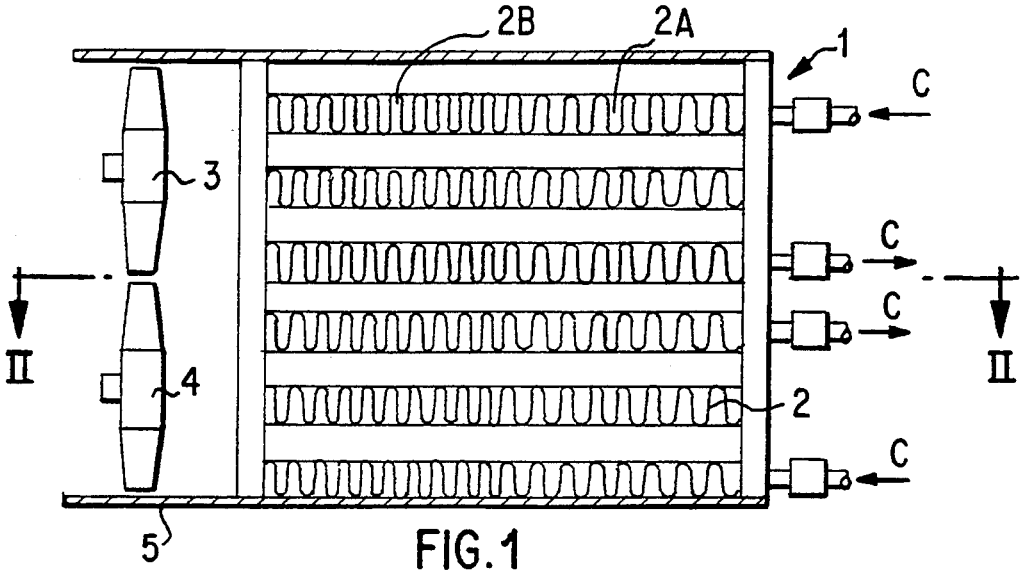
FIG. 1 is a front view of a radiator type cooling device with cooling air blowers disposed on the sides of the radiator in an airflow guide housing viewed in the direction of the arrows drawn in FIG. 2 on the section line I—I, constructed according to a preferred embodiment of the invention.
Figure 2:
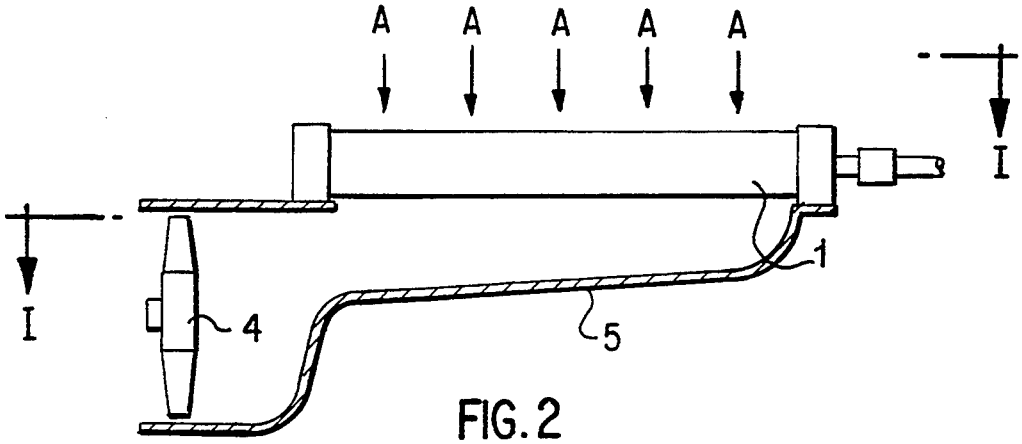
FIG. 2 is a plan view of the cooling device viewed in the direction of the arrows at the section line II—II in FIG. 1.

The cooling device for an internal combustion engine in accordance with FIG. 1 and FIG. 2 essentially comprises a radiator 1, an airflow guide housing 5 and two cooling air blowers 3 and 4 disposed on the side of the radiator 1. As shown in FIG. 1, coolant lines are connected with the radiator 1, through which coolant C is supplied to and drained from the radiator 1. The cooling air aspirated by the cooling air blowers 3, 4 (the flow is indicated by arrows A in front of the radiator) flows through the spaces of the radiator 1 in which cooling fins 2 are disposed. The cooling fins are primarily used for increasing the heat transfer surface and they are embodied as corrugated sheet metal segments, for example. The airflow guide housing 5 extends between the radiator 1 and the cooling air blowers 3, 4, and the cooling air flowing away from the radiator is deflected in guide housing 5 to the side toward the cooling air blowers 3, 4.

Figure 3:
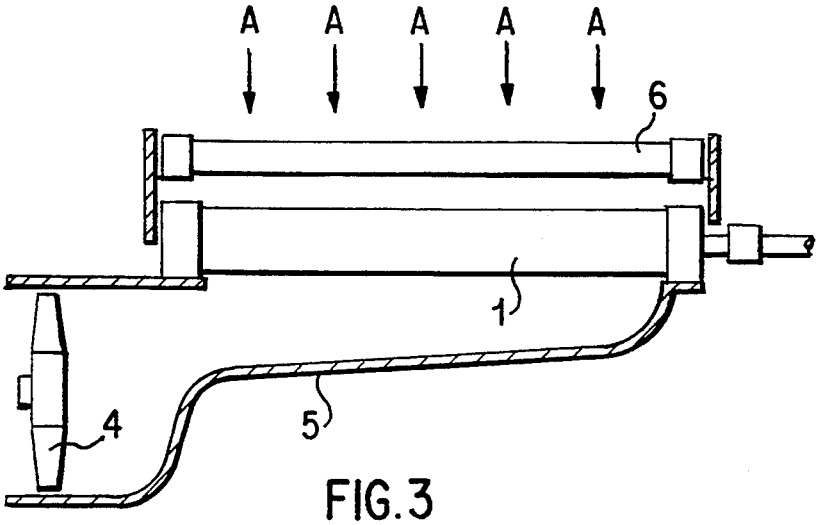
FIG. 3 is a view corresponding to that of FIG. 2, with the addition of a flow grating disposed in front of the radiator in the cooling air flow, constructed according to preferred embodiments of the invention.

FIG. 3 shows a cooling device corresponding to that of FIG. 2, wherein a flow grating 6 has been additionally disposed on the radiator in the area of the cooling air entry and which can be located in front or behind the radiator 1. The flow grating 6 is embodied to have segments which can also be pivotable in order to regulate the cooling air flow-through.

In a cooling device in accordance with the drawing figures with an asymmetric disposition of the cooling air blowers 3, 4 in respect to the radiator 1, when the flow resistance is the same over the entire surface of the radiator, the air flows through the radiator at a higher flow speed in the areas close to the cooling air blowers than in the areas remote from the cooling air blowers because of the flow paths of different length. To even out the flow to the radiator it has therefore been provided to embody the cooling fins 2 (2A, 2B) in the spaces of the radiator through which cooling air flows so they are closer together in the half of the radiator 1 close to the cooling air blowers (compare fins 2B) than in the half remote from the cooling air blowers (compare fins 2A). In this way a higher flow resistance is achieved in the half close to the cooling air blowers than in the half remote from the cooling air blowers. It is easy to realize that the efficiency of the radiator with the corresponding output of the cooling air blowers can be raised by this evening out of the flow, because air flows with optimum speed over the entire radiator surface. Furthermore, by increasing the closeness of the fins in the zone close to the cooling air blowers, the degree of exchange is also increased because of the increase of the heat exchange area.

The flow through the radiator 1 can be appropriately evened out with a corresponding closeness of the segments of the flow grating 6 in accordance with FIG. 3 upstream of the radiator 1. The increase in the flow resistance through the flow grating being generated by this grating can be compensated by a corresponding increase in the output of the cooling air blowers. The advantage of this design of the cooling device with a flow grating lies in that the cooling fin structure in the radiator is arbitrary and that it is possible to affect the efficiency of a radiator even at a later time in a simple manner, namely by the upstream placement of a suitable flow grating into the flow.

The design of the fins or segments is of course dependent on the position and design of the cooling air blowers and the airflow guide housing. Accordingly, it may be necessary for evening out the flow in certain preferred embodiments to increase or reduce the flow resistance in completely different areas of the radiator surface or the flow grating surface than in the above described exemplary embodiment.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cooling device for an internal combustion engine comprising:

a radiator through which a coolant flows, at least one cooling air blower disposed at one lateral side of the radiator for producing airflow in a blower direction, an air flow guide housing for guiding flow of air between the radiator and the at least one cooling air blower while deflecting the air flow direction, and a flow grating disposed on the radiator in the cooling air flow, which flow grating exhibits a flow resistance to the cooling air which is greater in areas close to the at least one cooling air blower than in areas remote from the at least one cooling air blower.

2. A device in accordance with claim 1, wherein the flow grating is embodied to have segments which are placed more closely together in the areas close to the at least one cooling air blower than in the areas remote from the at least one cooling air blower.

3. A device in accordance with claim 1, wherein the radiator is disposed upstream of the at least one cooling air blower.

4. A device in accordance with claim 1, wherein the at least one cooling air blower includes two cooling air blowers.

5. A cooling device for an internal combustion engine, comprising:

a radiator including cooling fins through which a coolant flows and over which cooling air flows in a first airflow direction transversely to the cooling fins, at least one cooling air blower disposed at one lateral side of the radiator for producing an airflow in a second airflow direction which is different than said first airflow direction, and an airflow guide housing disposed between the radiator and the at least one cooling air blower for guiding the airflow between the radiator and the at least one cooling air blower while deflecting said airflow between the second airflow direction and the first airflow direction, wherein the cooling fins of the radiator are asymmetrically disposed so as to present a greater resistance to airflow at a radiator side closest to the at least one airflow blower than at an opposite radiator side furtherest from the at least one airflow blower.

6. A device in accordance with claim 5, further comprising a flow grating at an air inlet side of the radiator, said flow grating having greater flow resistance to the cooling air in areas closer to the at least one cooling air blower than in areas further from the at least one cooling blower.

7. A device in accordance with claim 6, wherein the at least one cooing air blower includes two cooling air blowers.

8. A device in accordance with claim 7, wherein the radiator is disposed upstream of the at least one cooling air blower.

9. A device in accordance with claim 6, wherein said flow grating has segments spaced more closely together in the areas close to the at least one cooling air blower than in the areas further from the at least one cooling air blower.

10. A device in accordance with claim 9, wherein the at least one cooling air blower includes two cooling air blowers.

11. A device in accordance with claim 5, wherein the radiator is disposed upstream of the at least one cooling air blower.

12. A device in accordance with claim 5, wherein the at least one cooling air blower includes two cooling air blowers.

13. A device according to claim 3, wherein the cooling fins located on one-half of the radiator closest to the at least one cooling air blower are more closely spaced with respect to one another than are the cooling fins at the other half of the radiator.

14. A device according to claim 13, further comprising a flow grating at an air inlet side of the radiator, said flow grating having greater flow resistance to the cooling air in areas closer to the at least one cooling air blower than in areas further from the at least one cooling blower.

15. A device according to claim 14, wherein said flow grating has segments spaced more closely together in the areas close to the at least one cooling air blower than in the areas further from the at least one cooling air blower.

16. A device according to claim 15, wherein the radiator is disposed upstream of the at least one cooling air blower.

17. A device according to claim 16, wherein the at least one cooling air blower includes two cooling air blowers.

* * * * *